United States Patent [19]

Yamashita et al.

[11] 4,120,805

[45] Oct. 17, 1978

[54] ELECTROPHOTOGRAHIC LIQUID DEVELOPER CONTAINING NEGATIVELY CHARGED TONER

[75] Inventors: Hiroshi Yamashita; Sadao Osawa; Takashi Saida; Yutaka Sakasai, all of Asaka, Japan

[73] Assignee: Fuji Photo Film Co., Ltd., Kanagawa, Japan

[21] Appl. No.: 792,954

[22] Filed: May 2, 1977

[30] Foreign Application Priority Data

Apr. 30, 1976 [JP] Japan ..... 51-48418

[51] Int. Cl.[2] ..... G03G 9/12

[52] U.S. Cl. ..... 252/62.1 L; 96/1 LY

[58] Field of Search ..... 252/62.1 L, 62.1 R; 96/1.2, 1.1 LY

[56] References Cited

U.S. PATENT DOCUMENTS

| | | | |
|---|---|---|---|
| 3,671,646 | 6/1972 | Kurita et al. | 252/62.1 L |
| 3,729,418 | 4/1973 | Machida et al. | 252/62.1 L |
| 3,976,583 | 8/1976 | Herrmann et al. | 252/62.1 L |
| 4,032,463 | 6/1977 | Kawanishi et al. | 252/62.1 L |

FOREIGN PATENT DOCUMENTS

| | | | |
|---|---|---|---|
| 24,233 | 2/1976 | Japan | 252/62.1 L |
| 1,382,589 | 2/1973 | United Kingdom | 252/62.1 L |
| 1,016,072 | 1/1966 | United Kingdom | 252/62.1 L |

*Primary Examiner*—John T. Goolkasian

*Attorney, Agent, or Firm*—Sughrue, Rothwell, Mion, Zinn and Macpeak

[57] ABSTRACT

A process for producing a developer for electrostatic latent images comprising adding a solution (A) of a high-molecular weight compound having electron-donating functional groups dissolved in an organic solvent (1) which is a good solvent for the high-molecular weight compound to an organic solvent (2) in which the high-molecular weight compound is substantially insoluble, thereby depositing the high-molecular weight compound in a finely divided particle form, wherein an organic resin which is soluble in both of organic solvent (1) and organic solvent (2) is dissolved in at least one of solution (A) and organic solvent (2).

10 Claims, No Drawings

ELECTROPHOTOGRAHIC LIQUID DEVELOPER CONTAINING NEGATIVELY CHARGED TONER

BACKGROUND OF THE INVENTION

1. Field of the Invention

This invention relates to a process for producing a developer used for making visible electrostatic latent images in electrophotography, electrostatic recording, electrostatic printing, and the like, and more particularly, to a process for producing a liquid developer containing a toner having a negative charge.

2. Description of the Prior Art

Developers used for making electrostatic latent images visible are conventionally roughly classified as dry developers and wet developers from the standpoint of the form of the developer. In dry developers, coloring agents, such as carbon black, in finely divided form are used as toners, and known development methods using dry developers include the cascade method, the magnetic brush method, the powder cloud method, and the like.

On the other hand, wet developers include a pigment kneaded in an electrically insulating carrier liquid, a dye which has been chemically reacted with a dispersing resin and then dispersed in a carrier liquid, and the like. However, the use of pigments has the disadvantages that the color tone is restricted, and the resin combined is also restricted from the standpoint of electrical charge and dispersibility. Moreover, in using polymeric coloring materials in which the dye is chemically bonded to the polymer, technical skill in the synthesis, e.g., in the introduction of functional groups for the chemical bonding, is required. In addition, many proposals have been made so far for wet developers containing a toner having a negative charge, but they involve many problems that the electrical charge is unstable on long-time storage or on repeated use, the stability of the dispersion is poor, or the like.

SUMMARY OF THE INVENTION

Therefore, a first object of this invention is to provide a novel developer containing a toner having a negative charge in which the defects of the conventional developers are eliminated.

A second object of this invention is to provide a novel developer containing a finely divided toner having a negative charge whose characteristics are stable.

A third object of this invention is to provide a simple process for producing a wet developer.

A fourth object of this invention is to provide a process for producing a developer whose color tone can be selected freely.

Various investigations have been made, and as a result, it has now been found that the above and other objects of this invention are attained by producing a developer using an improved dissolving and depositing method, based on which this invention has been accomplished.

This invention provides a process for producing a developer for electrostatic latent images which comprises adding a solution (A) of a high-molecular weight compound having electron-donating functional groups dissolved in an organic solvent (1) to an organic solvent (2) in which the high-molecular weight compound is substantially insoluble, thereby depositing the high-molecular weight compound in a finely divided particle form, wherein an organic resin which is soluble in both of organic solvent (1) and organic solvent (2) is present in at least one of solution (A) and organic solvent (2).

DETAILED DESCRIPTION OF THE INVENTION

Finely divided toner particles can be obtained by incorporating the organic resin as described above in the process of this invention, and a toner having a negative charge can be obtained by combining the high-molecular compound having electron-donating functional groups with the resin. When an electrically insulating liquid is used as organic solvent (2), the developer obtained can be used as such as a wet developer.

A method of incorporating a soluble organic resin into a carrier liquid from the standpoint of dispersion stability is known. For example, a method of adding a soluble organic resin to a carrier liquid for improving the dispersion stability of a gelatin toner is described in Japanese Patent Publications Nos. 7,819/73 and 7,821/73. However, it is difficult to arrive at the present invention from a consideration of the above known facts only.

The characteristic features of this invention are explained below in detail. For convenience in the explanation, poly-N-vinylcarbazole (hereinafter referred to as PVK) will be used as representative of the high-molecular weight compound, and a copolymer of lauryl methacrylate and acrylic acid (hereinafter referred to as LMA-AA) will be used as representative of the organic resin.

LMA-AA is an organic resin soluble in a carrier liquid and can be used as an agent for stabilizing the electrical charge and the dispersion of the pigment. For example, with a phthalocyanine pigment and carbon black, LMA-AA acts to maintain their electrical charge positive and stable. PVK in finely divided particle form carries a positive charge, but when LMA-AA is present together therewith, the electrical charge is reversed to a negative charge, and in addition, the stability of this electrical charge is satisfactory according to the process of this invention. As described above, a toner having a negative charge can be obtained only when PVK and LMA-AA are used together.

That is, characteristic features of this invention are the ability to obtain a toner having a negative charge by combining the above-described high-molecular weight compound with the above described organic resin, and the ability to achieve fine particles of a toner and to stabilize the charge of a toner by the process of this invention in which the resin is added to solution (A) and/or organic solvent (2).

The magnitude of the charge of the toner delicately changes depending upon the combination of the high-molecular weight compound, the resin, a coloring agent and other factors. Toners carrying charges of different magnitudes can be obtained by a suitable selection of this combination.

High-molecular weight compounds which can be used for the toner of this invention are high-molecular weight compounds containing electron-donating functional groups. Such compounds include, for example, the following compounds.

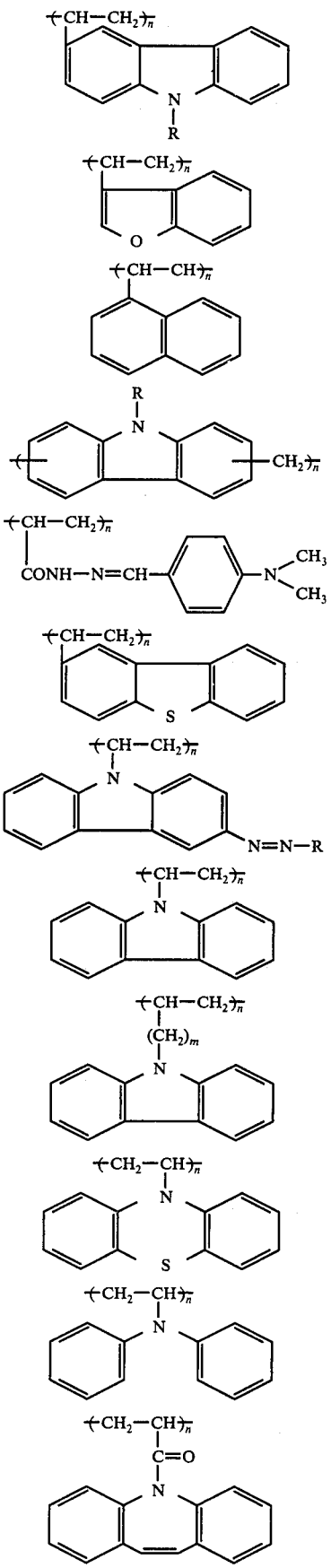

-continued

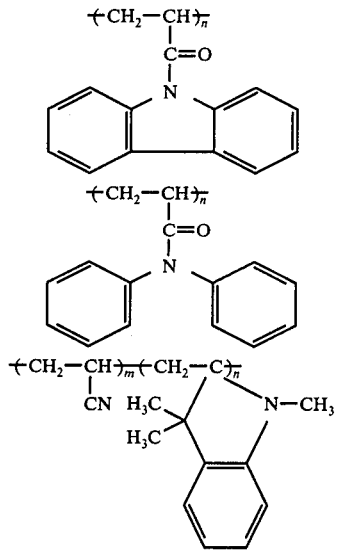

wherein N and the sum of $m + n$ each ranges from about 5 to about $10^4$, preferably about 5 to about $10^3$ with a suitable $m/n$ ratio of about 1:40 to about 50:1.

In the above formulas, R represents a straight-chain or branched chain alkyl group having 1 to 6 carbon atoms (e.g., methyl, ethyl, n-propyl, n-hexyl, iso-butyl, cyclohexyl, etc.) or a phenyl group, and these groups may be substituted with one or more substituents such as an alkyl group (e.g., having 1 to 12 carbon atoms such as methyl, ethyl, propyl, hexyl, decyl, dodecyl, etc.), an alkoxy group (e.g., having 1 to 12 carbon atoms such as methoxy, ethoxy, propoxy, hexyloxy, decyloxy, dodecyloxy, etc.), a hydroxy group, a halogen atom (e.g., F, Cl, Br, I, etc.) or a cyano group.

The molecular weight of the high-molecular weight compound preferably ranges from about 500 to about 1,000,000, particularly 1,000 to 200,000. Preferred electron-donating functional groups have an ionization potential ranging from about 6 to about 10 eV, preferably ranging from 7 to 9 eV. The ionization potential can be measured using the charge transfer method as described in R. Foster, *Molecular Complexes; Vol.* 1, Elek Science, London (1973), pages 1–48 or G. Briegleb, *Electron-Donator-Acceptor-Komplexe,* Springer-Verlag, Berlin (1961), pages 74–82 or by the half-wave oxidation potential polarographic method as described in A. Streitwiser Jr. *Molecular Orbital Theory for Organic Chemists,* John Wiley & Sons, Inc., New York, 1961 page 185 to 201 and P. O. Loufty and J. H. Sharp *Photo. Sci. Eng.* 20 (4) 165 (1976).

In general, it is preferred to use a coloring agent together with the high-molecular weight compound, although this is not particularly required when the high-molecular weight compound is colored. Examples of coloring agents which can be used include coloring materials (dyes) and Lewis acids. When a Lewis acid is used, a charge-transfer complex is formed between the Lewis acid and the electron-donating functional group, and coloration occurs. Various compounds are known as Lewis acids (for example, as disclosed in British Pat. No. 1,193,276). Organic Lewis acid compounds are preferred in this invention, and examples of such include anthraquinone, 1-nitroanthraquinone, 1,5-dichloroanthraquinone, chloranil, bromanil, tetracyanoethylene, o-nitrophenol, p-nitrophenol, trichloroacetic acid, tribromoacetic acid, p-benzoquinone, nitro-p-benzoquinone, cyano-p-benzoquinone, 2,3-dichloro-p-benzoquinone, 2,3-dichloro-5,6-dicyano-p-benzoquinone, 1,2-dinitrobenzene, 1,3,5-trinitrobenzene, 2,4,6-trinitrotoluene, 1,4-dicyanobenzene, 1,2,4,5-tetracyanobenzene, 2,4,7-trinitrofluorenone, 2,4,5,7-tetranitrofluorenone, tetranitrocarbazole, maleic anhydride, phthalic anhydride, tetrachlorophthalic anhydride, tetrabromophthalic anhydride, 7,7,8,8-tetracyanoquinodimethane, pyromellitic anhydride and picric acid.

Appropriate dyes which can be used can be selected from acid dyes, direct dyes, basic dyes, cationic dyes, mordant dyes, disperse dyes, metal complex dyes, sulfur dyes, oil-soluble dyes, reactive dyes and other dyes, these classes being based on the classification according to the dyeing method in which they are used. Moreover, based on classification according to chemical structure, appropriate dyes can be selected from azo dyes, anthraquinone dyes, carbonium dyes (diphenylmethane dyes, triphenylmethane dyes, xanthene dyes acridine dyes), quinoneimine dyes (azine dyes, oxazine dyes, thiazine dyes), methine dyes (cyanine dyes, azomethine dyes), quinoline dyes, nitro dyes and other dyes. The dyes are preferably selected from basic dyes, cationic dyes, disperse dyes and oil-soluble dyes from the standpoint of production, e.g., the selection of a solvent. Specific examples of these dyes are given below, and the term C.I. in the parentheses stands for the Color Index Number.

| | |
|---|---|
| Rhodamine 6G | (C.I. 45160) |
| Celliton Fast Blue FFR | (C.I. 61505) |
| Celliton Fast Orange | (C.I. 11080) |
| Sumiplast Blue G | (C.I. 61525) |
| Oil Violet R | (C.I. 61100) |
| Alizarine Cyanine Green G | (C.I. 61570) |
| Oil Green BB | (C.I. 61565) |
| Zapon Fast Red GE | (C.I. 12716) |
| Solvent Rhodamine B conc | (C.I. 45170B) |
| Mordant Black 51 | (C.I. 16510) |
| Miketon Fast Yellow 7G | (C.I. 48000) |
| Zapon Fast Yellow GR | (C.I. 13900A) |
| Sumikaron Blue BR | (C.I. 63305) |
| Paranyl Pink RF | (C.I. 60755) |
| Safranine G.K. conc | (C.I. 50240) |
| Aizen Victoria Pure Blue BOH | (C.I. 42595) |
| Sumiacryl Black G | (C.I. 11825) |
| Oil Brown R extra | (C.I. 12020) |
| Oil Yellow S | (C.I. 11020) |
| Eosine | (C.I. 45400) |
| Erythrosine | (C.I. 45430) |
| Acridine Red | (C.I. 45000) |
| Acridine Orange | (C.I. 46005) |
| Rhodamine B | (C.I. 45170) |
| Malachite Green | (C.I. 42000) |
| Crystal Violet | (C.I. 42555) |
| Methylene Blue | (C.I. 52015) |
| Methylene Green | (C.I. 52020) |
| Thionine | (C.I. 52000) |
| Methyl Green | (C.I. 42585) |
| Rhodamine S | (C.I. 45050) |

The organic solvent used as organic solvent (1) can be described as a good solvent capable of dissolving more than about 4 wt%, preferably more than about 10 wt% of the organic high molecular weight material, at room temperature (about 20°-30° C.) under atmospheric pressure. The organic solvent used as organic solvent (2) can be described as a non-solvent dissolving not more than about 0.5 wt% of the organic high molecular weight material, preferably dissolving no organic high molecular weight material, at room temperature under atmospheric pressure.

Good solvents and non-solvents for the high-molecular weight compounds, of course, differ as to each high-molecular weight compound. In general good solvents can be selected, for example, from aromatic hydrocarbons, halogenated hydrocarbons, cyclic ethers, esters, ketones, etc. Specific examples of good solvents are benzene, toluene, xylene, chlorobenzene, methylene chloride, chloroform, dichloroethane, tetrahydrofuran, benzyl acetate, cyclohexanone and N-methyl-2-pyrrolidone. Non-solvents can be selected from aliphatic hydrocarbons, alcohols, ethers, ketones, esters, acetals, diols, vegetable oils and others. Specific examples of non-solvents are methanol, ethanol, acetone, cyclohexane, n-hexane, decalin, diethyl ether, diisopropyl ether, ethylene glycol, methyl Cellosolve, propylene carbonate, ethylene carbonate, kerosene and silicone oils. When poly-N-vinylcarbazole is used as the high-molecular weight compound, suitable examples of solvents include aromatic hydrocarbons (e.g., benzene, toluene, xylene, etc.), halogenated hydrocarbons (e.g., dichloromethane, dichloroethane, chloroform etc.), cyclic ethers (e.g., dioxane, tetrahydrofuran etc.), N-methyl-2-pyrrolidone, cyclohexanone (e.g., for low molecular weight poly-N-vinyecarbazole etc.), etc., or mixtures thereof and suitable examples of non-solvents include aliphatic hydrocarbons (e.g., cyclohexane, n-hexane, isooctane, etc.), alcohols (e.g., isopropanol, benzyl alcohol, etc.), ketones (e.g., acetone, methyl ethyl ketone, etc.), esters (e.g., ethyl acetate, butyl acetate, etc.) etc. When a high-molecular weight compound of the formula

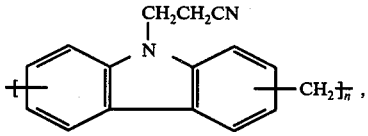

is used, suitable examples of solvents include halogenated hydrocarbons (e.g., dichloromethane, dichloroethane, tetrachloroethane etc.) cyclic ethers (e.g., tetrahydrofuran etc.), etc., and suitable examples of non-solvents are aliphatic hydrocarbons (e.g., cyclohexane, n-hexane, isooctane, etc.), etc. Also when a high-molecular-weight compound of the formula

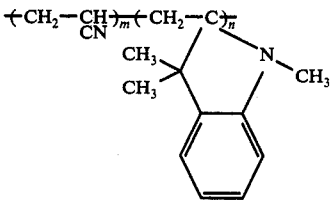

is used, suitable examples of solvents include halogenated hydrocarbons (e.g., dichloromethane, dichloroethane, etc.), cyclic ethers (e.g., tetrahydrofuran, etc.), N-methyl-2-pyrrolidone, etc. and suitable examples of non-solvents include aliphatic hydrocarbons (e.g., n-hexane, cyclohexane, isooctane, etc.). For the other high-molecular weight compounds, a suitable selection of solvents and non-solvents can be made by reference to J. Brandrup & E. H. Immergut Ed. *Polymer Handbook* Vol. IV. p. 185-234 Inter Science Publishers (1966). In general, the combination of dichloromethane as a solvent and an aliphatic hydrocarbon as a non-solvent can be effectively used for the high-molecular weight compound. One reason is because dichloromethane can be easily removed from the aliphatic hydrocarbon by heating or by passing dry air into the mixture because of the low boiling point (39.95° C.) and high vapor pressure of dichloromethane. In the other words, the solvent for the high-molecular weight compound has relatively low electrically insulation characteristics and such preferably is removed from the mixture from the standpoint of the effectiveness as a liquid type developer.

Examples of organic resins which can be used in this invention include alkyd resins (e.g., polylaurylmethacrylate, poly-2-ethylhexylmethacrylate, polylaurylacrylate, etc.), various modified alkyd resins (e.g., linseed oil modified alkyd resin (commercially available under the trade-name "Beckson J-535" produced by Nippon Reichold Co., Ltd.), safflower oil modified alkyd resin (commercially available under the trade-name "Supper Becksol ES-4611" produced by Nippon Reichold Co., Ltd.), etc.) acrylic resins, copolymers of higher alkyl esters of acrylic acid or methacrylic acid and various vinyl monomers, and other resins. Such organic resins are suitable if they have an appropriate solubility, adsorbability onto the surface of the particles of the high molecular weight compound and have the capability of improving the dispersion stability of the particles of the high-molecular weight compound. In particular, copolymers of alkyl esters of acrylic acid or methacrylic acid and various vinyl monomers are preferred. A suitable molar ratio of the vinyl monomer to the acrylic or methacrylic acid alkyl ester in these organic resins can range from about 1:100 to about 1.5:1, preferably 1:20 to about 1:2. Specific examples include a copolymer of lauryl methacrylate and 2-vinylpyridine, a copolymer of lauryl methacrylate and dimethylaminoethyl methacrylate, a copolymer of lauryl methacrylate and acrylic acid, a copolymer of lauryl methacrylate and crotonic acid, a copolymer of 2-ethylhexyl methacrylate, styrene and dimethylaminoethyl methacrylate and a copolymer of 2-ethylhexyl methacrylate, styrene and acrylic acid.

A suitable minimum solubility of the organic resin in organic solvent (1) and organic solvent (2) is at least about 0.05 wt%, preferably at least about 1 wt%. A suitable limiting viscosity; [η], for the organic resin can range from about 0.01 to about 0.5.

These components may be used individually or in combination. Suitable composition ratios of these components are given below.

| Solution or Dispersion of High-Molecular Weight Compound | Suitable Range (parts) | Preferred Range (parts) |
|---|---|---|
| High-molecular Weight Compound | 1 - 300 | 10 - 100 |
| Dye | 0 - 100 | 0.5 - 50 |
| Lewis Acid | 0 - 300 | 1 - 100 |
| Organic Resin | 0 - 500 | 10 - 300 |
| Organic Solvent (1) | 1000 | 1000 |
| Solution of Non-Solvent for High-Molecular Weight Compound | | |
| Organic Resin | 0 - 500 | 10 - 300 |
| Organic Solvent (2) | 1000 | 1000 |

With respect to the above composition ratios, the organic resin is present in an amount ranging from 5 to 500 parts by weight, preferably from 10 to 500 parts by weight, per 1000 parts by weight of either organic solvent (1) or (2) or the mixture thereof but particularly preferably at least some of the organic resin is present in organic solvent (2).

In particular, the addition of an organic resin to both of organic solvent (1) and organic solvent (2) makes it possible to form finer particles.

Some of the important advantages of this invention are given below.

(1) A novel developer containing a toner having a negative charge in which conventional defects are eliminated can be prepared.

(2) A developer containing a fine and stable toner having a negative charge can be obtained.

(3) A wet developer can be prepared using a simple method.

(4) The color tone can be selected freely.

One embodiment of the process of this invention is set forth below. For convenience in explanation, PVK is used as representative of the high-molecular weight compound, and LMA-AA is used as representative of the resin.

A solution (Solution A) comprising PVK and Rhodamine B (coloring agent) dissolved in dichloromethane (Organic Solvent (1) ) is dropwise added to Isopar H (trade name for an isoparaffin hydrocarbon produced by Esso corresponding to Organic Solvent (2) ) containing LMA-AA dissolved therein, thereby depositing PVK particles. To prevent aggregation of the particles and to improve dispersibility, the Isopar H is mechanically stirred using a stirrer while applying ultrasonic waves (this method will be hereinafter referred to for brevity as "ultrasonic dispersing method"). As the stirrer, a Three-One Motor made by Shinto Kagaku Co., Ltd. is used, and an Ultrasonic Oscillator of Type 4322 made by Kaijo Denki Co., Ltd. is used for ultrasonic application. The frequency is 29 KC and the output is 150 W. Thus, fine PVK particles which are dyed magenta are obtained in the Isopar H. The resulting solution is filtered, and then, washed with Isopar E (trade name for an isoparaffin hydrocarbon produced by Esso) and dried to obtain magenta-colored powders. The powders can be used as such as a dry toner.

The diameter of the toner particles obtained depends upon the concentration of Solution (A), the ratio of Organic Solvent (1) and Organic Solvent (2), the molecular weight of the high-molecular weight compound, and the like. The rate of addition of Solution (A) to Organic Solvent (2) has no marked influence on the process. In general, the toner particles obtained in accordance with the present invention have diameter of about 0.05 to about 10μ and an average particle size of about 0.2 to about 0.3μ. A toner having a particle size of about 0.05 to 2 μm is preferably used in a conventional developer. The toner particles produced in the invention have a zeta potential ranging from about −5 mV to about −70 mV in when the zeta potential is evaluated electrophoretically (e.g., as disclosed A. Kitahara "*Progress in Organic Coating*" 2 p.p. 81–98 (1973/1974)) and are stable at room temperature under atmospheric pressure even after 1 year. However, after extremely long term storage the toner is preferably re-dispersed at use. Toners with various color hues (even black) and color densities can be prepared as desired depending upon the selection of the dye and organic Lewis acid. For general applications, black, and the three colors i.e., yellow, magenta, and cyan, are suitable.

This invention will be explained in more detail by reference to the following examples. Unless otherwise indicated herein, all parts, percentages, ratios and the like are by weight.

EXAMPLE 1

A solution comprising

| | | |
|---|---|---|
| Polyvinylcarbazole (molecular weight: about 200,000) | 2 | g |
| Crystal Violet (coloring agent) | 0.2 | g |
| Methylene Chloride (solvent) | 40 | g |
| Copolymer of Lauryl Methacrylate and Acrylic Acid (40% Isopar H solution) | 2 | g |

was dispersed in 1 liter of Isopar H containing 10 g of a copolymer of lauryl methacrylate and acrylic acid (as a 40% Isopar H solution) using the ultrasonic dispersing method to obtain a blue-purple dispersion of a fine toner. This was used as such as a liquid developer.

On the other hand, an electrophotographic light-sensitive material in which 8 parts by weight of zinc oxide was dispersed in one part by weight of an electrically insulating binder (Dianal LR-008 trade-name produced by Mitsubishi Rayon K.K.) was prepared, electrostatically charged in a conventional manner and then exposed to light through a negative original. The sheet having thereon an electrostatic latent image of a negative charge was wet with fresh Isopar H. The developer prepared with the formulation and procedure as described above was divided into two equal portions, and the sheet was immersed in one of the portions. At this time, the developer was placed in a stainless steel vat, and the surface having the latent image of the sheet thereon was brought close to the bottom of the vat, thus applying the effect of close electrodes. After development, the sheet was washed with fresh Isopar E and dried to obtain a sharp blue-purple positive image. The $D_{max}$ was 1.32, and the $D_{fog}$ was 0.13 (fog density). The same development procedure was repeated using this developer. The development could be effected with little change up to 50 times. A reduction in the density was observed after about 40 times, but this was attributed to a decrease in the toner concentration. No indications of lack of stability or reversal of the charge of the toner were observed. On the other hand, the remaining portion of the developer was further divided into two portions. One of the portions was allowed to stand in a room for 30 days and another portion was allowed to stand for 90 days, and then, development was effected. In both cases, positive images of an image quality which scarcely differed from that obtained using the fresh developer on the first day were obtained. The results of durability testing were almost the same.

For comparison, PVK particles were prepared using the same formulation as in Example 1 except the copolymer of lauryl methacrylate and acrylic acid was omitted, filtered off, washed with Isopar E and then dried to obtain a bright blue-purple powder.

The following composition:

| | | |
|---|---|---|
| Blue-purple Powder (prepared as described above) | 2 | g |
| Copolymer of Lauryl Methacrylate and Acrylic Acid (10 mol% acrylic acid per mol lauryl methacrylate; [μ] : 0.13) | 11 8 | g |
| Isopar H | 25 | g |
| Glass Beads ($\phi$ = 0.5 mm) | 10 | g |

was stirred at 10,000 rpm for 15 minutes using a homogenizer (made by Nihon Seiki Mfg. Co., Ltd.) to obtain a paste of a liquid developer. The paste was diluted 20 times (by volume) with Isopar H to form a liquid developer. Development was effected in the same manner as in Example 1. On the first day, a clear blue-purple positive image was obtained. The $D_{max}$ was 1.24 and the $D_{fog}$ was 0.14. On the other hand, when development was effected after 30 days, only a blurred image could be obtained which had a $D_{max}$ of 0.95 and a $D_{fog}$ or 0.37.

From the above results, it can be seen that the process of this invention is excellent in that a toner having a negative charge can be obtained by combining PVK with LMA-AA (resin), and fine toner particles can be produced, and further, the developer can be simply prepared, the stability of the charge of the toner is very satisfactory, and the like.

EXAMPLE 2

A solution comprising

| | | |
|---|---|---|
| Polyvinylcarbazole (mol. wt.: about 200,000) | 2 | g |
| Oil Green (coloring agent) | 0.2 | g |

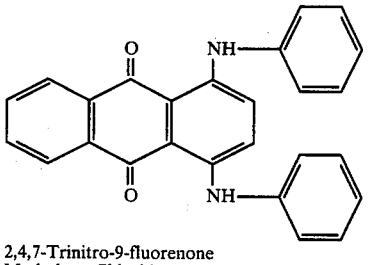

| | | |
|---|---|---|
| 2,4,7-Trinitro-9-fluorenone | 2 | g |
| Methylene Chloride | 40 | g |
| Terpolymer of 2-Ethylhexyl Methacrylate, Styrene and Dimethylaminoethyl Methacrylate (molar ratio 1:0.1:0.1; [η]: 0.21) | 5 | g |

was dispersed in 1 liter of Isopar H containing 10 g of a terpolymer of 2-ethylhexyl methacrylate, styrene and dimethylaminoethyl methacrylate using the ultrasonic dispersing method to obtain a black liquid developer.

A latent image carrying negative charge was formed on a ZnO light-sensitive layer in the same manner as in Example 1 and developed with the above produced black developer to obtain a black positive image having a $D_{max}$ of 1.16 and a $D_{fog}$ of 0.23.

EXAMPLE 3

A solution comprising

| | | |
|---|---|---|
| Polyvinylcarbazole (molecular weight: about $10^5$) | 2 | g |
| Sumiplast Blue G | 0.3 | g |
| Methylene Chloride | 50 | g |

was dispersed in 1 liter of Isopar H containing 5 g of a copolymer of lauryl methacrylate and dimethylaminoethyl methacrylate (molar ratio 1:0.2; [η]: 0.17) using the ultrasonic dispersing method to obtain a blue developer.

When the size of the particles was observed using an electron microscope, the average particle size (as a diameter) was about 0.2 μ. The measured value of the ξ-potential of the toner was about − 34 mV. On the other hand, on an art paper which had been rendered electrically-conductive, a solution having the following composition:

| | | |
|---|---|---|
| Polyvinylcarbazole ([η]: 0.034) | 24 | g |
| Toluene | 158 | g |
| Cyclohexanone | 18 | g |

was coated to prepare an electrophotographic light-sensitive material. This light-sensitive material was electrostatically charged and exposed to light (through a negative original) using a conventional procedure in the electrophotographic industry to form an electrostatic latent image, which was then developed with the above developer. For the latent image carrying negative charge, a positive image with $D_{max} = 1.04$ and a $D_{fog} = 0.20$ was obtained, and for the latent image of a positive charge, a negative image with a $D_{max} = 1.26$ and a $D_{fog} = 0.18$ was obtained. Both of the images were clear.

EXAMPLE 4

A solution comprising

| | | |
|---|---|---|
| Polyvinylcarbazole (molecular weight: about $10^3$) | 1 | g |
| Sumiplast Blue G (coloring agent) | 0.2 | g |
| Copolymer of Lauryl Methacrylate and Acrylic Acid (molar ratio 1:0.05; [η]:0.13; 40% Isopar H solution) | 5 | g |
| Methylene Chloride | 50 | g |

was dispersed in 1000 ml of Isopar H using the ultrasonic dispersing method to obtain a developer. When the developer was used as a liquid developer, this toner carried a negative charge.

EXAMPLES 5 TO 9

Toners were prepared in the same manner as in Example 1 except for using various polymers in place of the polyvinylcarbazole.

HIGH-MOLECULAR WEIGHT COMPOUND

Ex. 5 Polyvinylphenothiazine (mol wt: several ten thousands)
Ex. 6 Polyvinyldiphenylamine (mol wt: several ten thousands)
Ex. 7

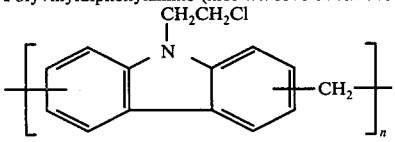

N ≃ 500

Ex. 8

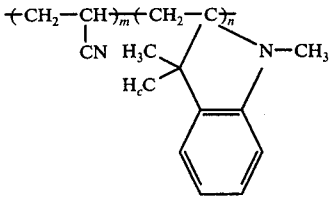

m + n ≃ 500

Ex. 9

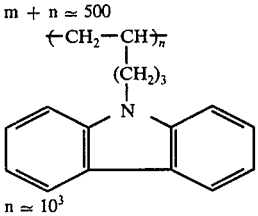

n ≃ $10^3$

All of the toners could be used as such as liquid developers, and they carried a negative charge. The stability of the charge was satisfactory.

EXAMPLE 10

A developer was obtained in the same manner as in Example 1 except for using a cyanine dye represented by the formula

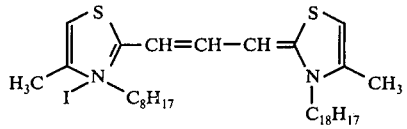

in place of Crystal Violet as a coloring agent. The toner carried a negative charge, and the stability of the charge was satisfactory.

EXAMPLES 11 to 16

Developers were prepared in the same manner as in Example 1 except for using various dyes or Lewis acids in place of Crystal Violet.

| | Coloring Agent |
|---|---|
| Example 11 | Malachite Green |
| Example 12 | 2,4,7-Trinitro-9-fluorenone |
| Example 13 | Malachite Green and 2,4,7-Trinitro-fluorenone |
| Example 14 | Rhodamine 6G |
| Example 15 | Oil Violet R |
| Example 16 | |

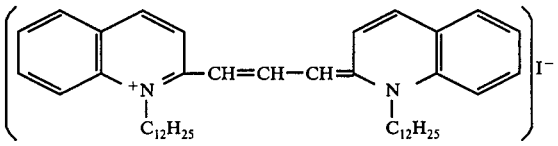

All of the developers could be used as liquid developers, and clear images were obtained.

EXAMPLE 17

50 g of trichloroacetic acid was further added to the developer of Example 14, followed by ultrasonic dispersion. The resulting developer showed a remarkably improved charge stability as compared with the case of Example 14.

The developer was kept under usual conditions, and after one and a half years, it was used for development. The developer carried a negative charge and showed that satisfactory development characteristics were retained.

EXAMPLE 18

A solution comprising

| | | |
|---|---|---|
| A solution comprising | | |
| Polyvinylphenothiazine (mol wt: about 50,000) | 1 | g |
| Acridine Red | 0.05 | g |
| Copolymer of 2-Ethylhexyl Methacrylate and Acrylic Acid (molar ratio 1:0.3; [η] 0.23; 40% Isopar H solution) | 3 | g |
| Methylene Chloride | 30 | g |

was dispersed in 700 ml of Isopar E containing 6 g of a copolymer of lauryl methacrylate and acrylic acid (molar ratio 1:0.1; [η] 0.13) using the ultrasonic dispersing method, and then, the resulting dispersion was concentrated using a rotary evaporator (made by Tokyo Rika Kikai Co., Ltd.) to a total volume of about 80 ml, which was then dispersed for 28 hours using a ball mill with stainless steel balls and diluted with 100ml of Isopar H. The resulting composition was used as a liquid developer.

A ZnO light-sensitive layer was developed to obtain a satisfactory image with a $D_{max}$ = 1.87 and a $D_{fog}$ = 0.17. Also in this case, the toner had a negative charge.

EXAMPLE 19

A developer was prepared in the same manner as in Example 1 except for using 50 mg of a dye represented by the following formula in place of 0.2 g of Crystal Violet.

Structural Formula of The Dye

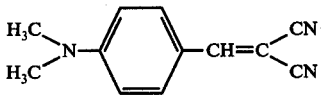

The measured value of the ζ-potential of the toner thus obtained was about − 27 mV.

While the invention has been described in detail and with reference to specific embodiments thereof, it will be apparent to one skilled in the art that various changes and modifications can be made therein without departing from the spirit and scope thereof.

What is claimed is:

1. An electrophotographic liquid developer containing a negatively charged toner, which developer is produced by the process which comprises: adding a solution (A) of a high-molecular weight compound having a molecular weight of about 500 to about 1,000,000 consisting essentially of a skeletal structure selected from the group consisting of:

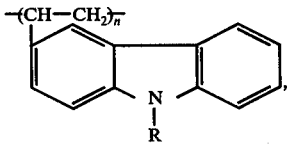

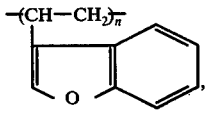

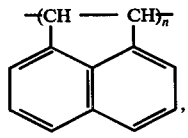

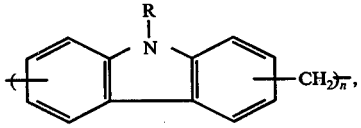

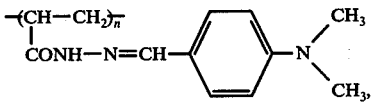

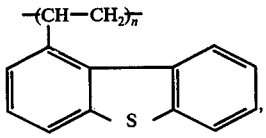

-continued

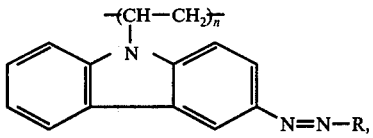

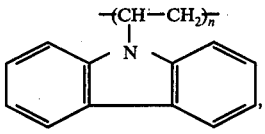

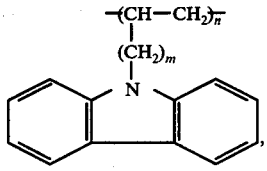

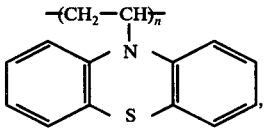

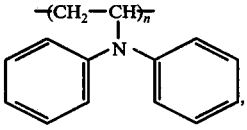

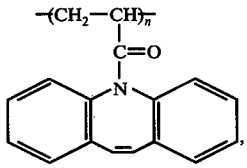

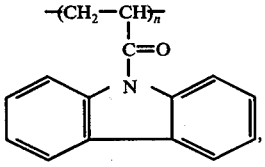

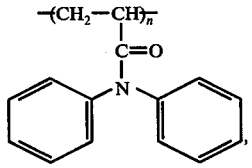

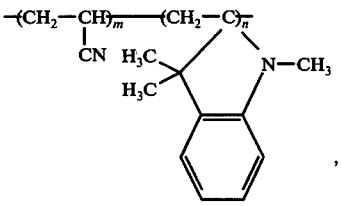

, and wherein N and the sum of $m + n$ each ranges from about 5 to about $10^4$ and the ratio $m/n$ ranges from about 1:40 to about 50:1, where R is an alkyl group having 1 to 6 carbon atoms, a phenyl group, an alkoxy group, a hydroxy group, a halogen atom or a cyano group which high molecular weight compound is dissolved in an electrically insulating solvent (1) which dissolves more than about 4 wt. % of the high-molecular weight compound at room temperature and at atmospheric pressure to an organic solvent (2) in which the high-molecular weight compound is substantially insoluble, thereby depositing the high-molecular weight compound in a finely divided particle form, wherein an organic resin which is soluble in both of organic solvent (1) and organic solvent (2) in an amount of at least about 0.05 wt. % is dissolved in at least one of solution (A) and organic solvent (2), said developer being used as such as a wet developer.

2. The developer of claim 1, wherein said organic resin is dissolved in solution (A).

3. The developer of claim 1, wherein said organic resin is dissolved in organic solvent (2).

4. The developer of claim 1, wherein said organic resin is dissolved in both solution (A) and organic solvent (2).

5. The developer of claim 1, wherein said solution (A) of said high molecular weight compound contains additionally at least one of a dye and a Lewis acid.

6. The developer of claim 5, wherein said solution contains said dye.

7. The developer of claim 5, wherein said solution contains Lewis acid.

8. The developer of claim 1, wherein said resin is a copolymer of an alkyl ester of acrylic acid or methacrylic acid with a vinyl monomer copolymerizable therewith.

9. The developer of claim 8, wherein said copolymer of said alkyl ester with a vinyl monomer is adsorbed onto the surface of the high molecular weight compound and improves the dispersion capability of the high molecular weight compound.

10. The developer of claim 9, wherein said copolymer of said alkyl ester with a vinyl monomer is a copolymer of lauryl methacrylate and 2-vinylpyridine, a copolymer of lauryl methacrylate and dimethylaminoethyl methacrylate, a copolymer of lauryl methacrylate and acrylic acid, a copolymer of lauryl methacrylate and crotonic acid, a copolymer of 2-ethylhexyl methacrylate, styrene and dimethylaminoethyl methacrylate or a copolymer of 2-ethylhexyl methacrylate, styrene and acrylic acid.

* * * * *